US006602150B1

(12) United States Patent
Kosmatka

(10) Patent No.: US 6,602,150 B1
(45) **Date of Patent: *Aug. 5, 2003**

(54) GOLF CLUB STRIKING PLATE WITH VIBRATION ATTENUATION

(75) Inventor: John B. Kosmatka, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 183 days.

This patent is subject to a terminal disclaimer.

(21) Appl. No.: 09/679,653

(22) Filed: Oct. 5, 2000

(51) Int. Cl.[7] ..... A63B 53/04
(52) U.S. Cl. ..... 473/342; 473/332; 473/345
(58) Field of Search ..... 473/332, 342, 473/324, 334, 345, 350, 346

(56) References Cited

U.S. PATENT DOCUMENTS 4,964,640 A * 10/1990 Nakanishi et al. ..... 473/345
5,316,298 A 5/1994 Hutin et al.
5,318,300 A 6/1994 Schmidt et al.
5,346,216 A 9/1994 Aizawa
5,409,229 A * 4/1995 Schmidt et al. ..... 473/332
5,505,453 A 4/1996 Mack
5,697,855 A * 12/1997 Aizawa ..... 473/350
5,830,084 A 11/1998 Kosmatka
5,888,148 A * 3/1999 Allen ..... 473/290
5,954,596 A 9/1999 Noble et al.
5,971,868 A 10/1999 Kosmatka
6,398,666 B1 * 6/2002 Evans et al. ..... 473/345
6,428,427 B1 * 8/2002 Kosmatka ..... 473/349

* cited by examiner

*Primary Examiner*—Steven Wong
(74) *Attorney, Agent, or Firm*—Michael A. Catania

(57) ABSTRACT

A golf club head (20) having a striking plate (30) and means for vibration attenuation (35) disposed thereon. The vibration attenuation means (35) may be composed of a low-density. metallic, a polymer material, or a filled polymer material. The striking plate (30) may have a uniform thickness or a variable thickness. The overall thickness of the striking plate (30) and vibration attenuation means (35) is preferably in the range of 0.100 inch to 0.250 inch. The striking plate (30) is preferably composed of steel or titanium.

12 Claims, 6 Drawing Sheets

GOLF CLUB STRIKING PLATE WITH VIBRATION ATTENUATION

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf club striking plate. More specifically, the present invention relates to a golf club striking plate having means for vibration attenuation.

2. Description of the Related Art

Present golf clubs have repositioned weight in order to lower the center of gravity for better performance. This repositioning of weight has for the most part attempted to thin the crown and striking plate of the golf club while precisely placing the weight in the sole of the golf club. However, thinning the striking plate too much may lead to failure of the golf club.

When the striking plate impacts a golf ball during a swing, large impact forces (in excess of 2000 pounds) are produced thereby loading the striking plate. In the relatively thin striking plates of hollow metal woods and cavity-back irons, these forces tend to produce large internal stresses in the striking plate. These internal stresses often cause catastrophic material cracking which leads to failure of the club head.

Computational and experimental studies on hollow metal woods and cavity-backed irons have demonstrated that such catastrophic material cracking most often occurs at impact points on the striking plate. These impact points require added strength to prevent club head failure.

In designing golf club heads, the striking plate must be structurally adequate to withstand large repeated forces such as those associated with impacting a golf ball at high speeds. Such structural adequacy may be achieved by increasing the striking plate stiffness so that the stress levels are below the critical stress levels of the material used in the striking plate. Typically, for metal woods, the striking plates are stiffened by uniformly increasing the thickness of the striking plate and/or by adding one or more ribs to the interior surface of the striking plate.

Uniformly increasing the thickness of the striking plate portion typically requires the addition of large amounts of material to adequately reduce the stress sufficient to prevent impact and/or fatigue cracking. However, the addition of such a large amount of material to a striking plate generally adversely affects the performance of the golf club.

One of the first patents to disclose variable face thickness was U.S. Pat. No. 5,318,300 to Schmidt et al., for a Metal Wood Golf Club With Variable Faceplate Thickness which was filed on Nov. 2, 1992. Schmidt et al discloses thickening the faceplate to prevent cracking.

A further disclosure of variable face thickness is disclosed in U.S. Pat. No. 5,830,084 to Kosmatka for a Contoured Golf Club Face which was filed on Oct. 23, 1996. Kosmatka addresses contouring the face to thicken certain regions while thinning other regions depending on the stress load experienced by such regions. Kosmatka also discloses a method for designing a face plate according to measured stress levels experienced during impact with a golf ball. Kosmatka, U.S. Pat. No. 5,971,868 for a Contoured Back Surface Of Golf Club Face, filed on Nov. 18, 1997, discloses similar contouring for an iron.

A more recent disclosure is Noble et al., U.S. Pat. No. 5,954,596, for a Golf Club Head With Reinforced Front Wall, which was filed on Dec. 4, 1997. The Noble et al. patent discloses a face plate with the thickness portion at the geometric center, and gradually decreasing toward the top and bottom, and the sole and heel. The top and bottom ends along a line through geometric center have the same thickness, and the heel and sole ends along a line through geometric center have the same thickness.

Other references make partial disclosure of varying face thickness. One example is FIG. 8 of U.S. Pat. No. 5,505,453 which illustrates an interior surface of a face with a bulging center and decreasing thickness towards the heel and sole ends, similar to Noble et al. patent. Another example is FIGS. 4C and 4D of U.S. Pat. No. 5,346,216 which discloses a bulging center that decreases in thickness toward the heel and sole ends, and the top and bottom end of the face, similar to Noble et al. patent.

Hutin et al., U.S. Pat. No. 5,316,298, for a Golf Club Head Having Vibration Damping Means, filed originally in France in 1992, discloses the use of a vibration damper on a golf club head. The main object of the Hutin patent is to attenuate the vibrations during impact with a golf ball. Hutin does not address performance, and the thickness of the striking plate. The Hutin patent discloses using a rigid plate, preferably composed of aluminum, which is attached to the interior surface by a visco-elastic material.

However, thinning of the face, either uniformly or variably, may lead to undesirable localized natural frequencies that sound "tinny" when the golf club impacts a golf ball. AN undesirable sound deters from the sensation that a golfer feels during a shot, especially a good shot. Thus, although high performance drivers can increase the distance that a golf ball travels after impact with a driver, the undesirable sound may neutralize this positive effect.

BRIEF SUMMARY OF THE INVENTION

The present invention is directed at a golf club head having a thin striking plate that lessens the tinny noise created during impact with a golf ball. The present invention is able to accomplish this by providing a vibration attenuation means on the interior surface of the striking plate.

One aspect of the present invention is a golf club head including a body, a striking [plate and a vibration attenuation backing. The body has a crown, a sole, a heel end, a toe end and a hollow interior. The striking plate is attached to the body, and has an exterior surface and an interior surface. The striking plate also has a thickness that varies from 0.030 inch to 0.250 inch. The vibration attenuation backing is disposed on the interior surface of the striking plate within the hollow interior of the body. The combination of the striking plate and the vibration attenuation backing has a minimum thickness of at least 0.100 inch at any point between the exterior surface of the striking plate and the hollow interior.

Another aspect of the present invention is a golf club head with a body, a unitary striking plate and a means for vibration attenuation thereon. The body has a crown, a sole, a heel end and a toe end. The unitary striking plate includes a central region, a transition region, a first peripheral region and a second peripheral region. The central region has a first thickness ranging from 0.090 inch to 0.145 inch and occupying 5% to 15% of the exterior surface of a core face area. The transition region encompassing the central region and occupies 35% to 50% of the exterior surface of a core face area. The first peripheral region encompasses the transition region and occupies 40% to 55% of the exterior surface of the core face. The first peripheral region has a second thickness less than the first thickness and ranges from 0.040 inch to 0.110 inch. The transition region has a thickness that transitions from the first thickness to the second thickness. The second peripheral region encompasses the first peripheral region and has a third thickness that ranges from 0.010 inch to 0.085 inch. The vibration attenuation means is disposed on an interior surface of the striking plate within the hollow interior of the body. The vibration attenuation means has a thickness between 0.010 inch and 0.150 inch.

The vibration attenuation means may be composed of a polymer, a low density metal or a composite material. Preferably, the vibration attenuation means is composed of a material that matches either the specific compression and/or shear stiffness of the longitudinal and/or transverse wave impedance of the striking plate material.

Having briefly described the present invention, the above and further objects, features and advantages thereof will be recognized by those skilled in the pertinent art from the following detailed description of the invention when taken in conjunction with the accompanying drawings.

Figure 1:
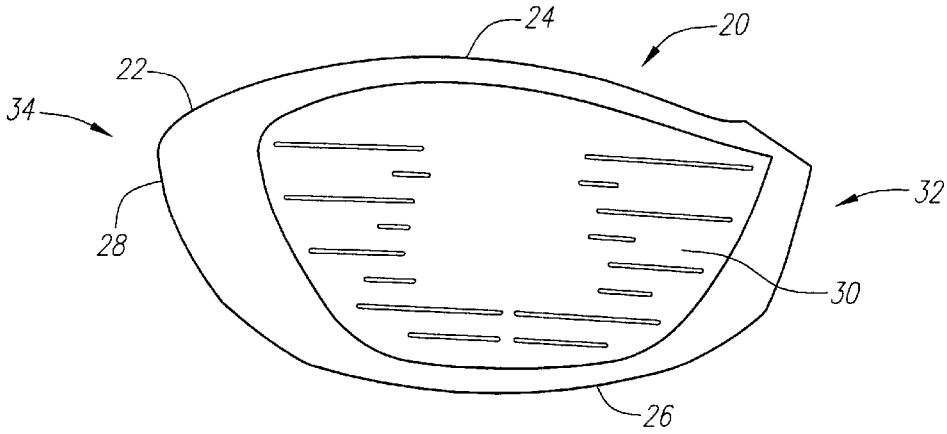
FIG. 1 is a front plan view of a golf club head with the striking plate of the present invention.

DETAILED DESCRIPTION OF THE INVENTION.

As shown in FIGS. 1–8, a golf club head is generally designated 20. The golf club head has a body 22 with a crown 24, a sole 26, a ribbon 28 and a striking plate 30. The striking plate 30 generally extends from a heel end 32 to a toe end 34 of the front of the golf club head 20. The body 22 preferably has an internal hosel 36 for receiving the tip end of a shaft, not shown, through an aperture 38. The golf club head has a body 22 that is preferably composed of a metal material such as titanium, titanium alloy, stainless steel, or the like, and is most preferably composed of a forged titanium material. The body 22 preferably has a large volume, most preferably greater than 300 cubic centimeters, and is most preferably 350 cubic centimeters. The body 22 preferably weighs no more than 215 grams, and most preferably weighs between 180 and 205 grams. The body 22 has a hollow interior 23.

The striking plate 30 may have a uniform thickness or a variable thickness. The exterior surface 53 of the striking plate is substantially smooth for impact with a golf ball (except for the scorelines), while the interior surface 55 of the striking plate may be uniform or vary in thickness. The thickness of the striking plate 30 ranges from 0.010 inch to 0.300 , preferably from the 0.040 inch to 0.250 , and most preferably from 0.060 inch to 0.150 inch. The thickness of the striking plate 30 is greatly determined by the size of the golf club head 20, and the material composition of the striking plate 30. Titanium alloys have a lower density than stainless steel, and thus a titanium alloy striking plate 30 allows for the weight to be distributed elsewhere in the body 22.

A vibration attenuation backing 35 is attached to the interior surface 55 of the striking plate 30. The vibration attenuation backing 35 may cover the entire interior surface 55, or only a portion of the interior surface 55. The vibration attenuation backing 35 has a thickness that ranges from 0.010 inch to 0.250 inch, more preferably from 0.050 inch to 0.100 inch, and most preferably 0.075 inch. The overall thickness of the striking plate 30 and the vibration attenuation backing 35 preferably ranges from 0.030 inch to 0.500 inch, more preferably from 0.075 inch to 0.250 inch, and most preferably is 0.100 inch.

It was found that the material of the vibration attenuation backing 35 that gave the best results had either a specific stiffness or a wave impedance that closely matched the material of the striking plate 30. The specific stiffness is characterized by either the specific compression stiffness (E/ρ) or the specific shear stiffness (G/ρ), where (E, G, and ρ) are the material compression stiffness, shear stiffness, and density, respectively. Equations that represent the preferred non-dimensional ratio of specific compression stiffness and specific shear stiffness for the materials of the vibration attenuation backing 35 and the striking plate 30 are given by;

$$0.90\left\langle\frac{E_{35}}{E_{30}}\frac{\rho_{30}}{\rho_{35}}\right\langle 1.10 \quad \text{and} \quad 0.90\left\langle\frac{G_{35}}{G_{30}}\frac{\rho_{30}}{\rho_{35}}\right\langle 1.10$$

where, the subscripts (30) and (35) are the material properties are associated with the striking plate and vibration attenuation backing, respectively. The wave impedance of the materials of the vibration attenuation backing 35 and the striking plate 30 are considered matched if they have either the same longitudinal wave impedance ($Z_L$);

$$Z_L = \rho\sqrt{\frac{E}{\rho}\frac{(1-\nu)}{\rho(1+\nu)(1-2\nu)}} = \sqrt{\frac{E\rho(1-\nu)}{(1+\nu)(1-2\nu)}}$$

or the same transverse wave impedance ($Z_t$);

$$Z_T = \rho\sqrt{\frac{E}{\rho}\frac{1}{2(1+\nu)}} = \rho\sqrt{\frac{G}{\rho}} = \sqrt{G\rho}$$

where ($\nu$) is the Poisson ratio of the material. Equations that represent the preferred nondimensional ratio of longitudinal and transverse wave impedance for the materials of the vibration attenuation backing 35 and the striking plate 30 are given by;

$$0.90\langle\sqrt{\frac{E_{35}}{E_{30}}\frac{\rho_{35}}{\rho_{30}}\frac{(1-\nu_{35})}{(1-\nu_{30})}\frac{(1+\nu_{30})}{(1+\nu_{35})}\frac{(1-2\nu_{30})}{(1-2\nu_{35})}} \approx \sqrt{\frac{E_{35}}{E_{30}}\frac{\rho_{35}}{\rho_{30}}}\langle 1.10$$

and $$0.90\langle\sqrt{\frac{G_{35}}{G_{30}}\frac{\rho_{35}}{\rho_{30}}}\langle 1.10.$$

The vibration attenuation backing 35 is preferably composed of a polymer material, a composite material, a lightweight metal material, or the like. Polymer materials that are used for the vibration attenuation backing 35 include polyurethanes, polyamides, polyimides, polycarbonates, and the like. Lightweight metal that are used for the vibration attenuation backing 35 materials include titanium, aluminum, steel, iron alloys, brass, germanium, magnesium, zirconium alloys, and the like.

Preferably, the striking plate 30 is partitioned into a plurality of regions 40, 42, 44 and 46, defined by lines 41, 43, 45 and 47, each having a different thickness or different thickness range. The striking plate 30 is unitary in construction, and may or may not be composed of the same material of the body 22. The term unitary when used in conjunction with the striking plate 30 means that the striking plate 30 is a single piece and does not have additions to the interior surface 55 such as ribs or weighting members. The vibration attenuation backing 35 is a separate component from the striking plate 30. A central region 40, defined by dashed line 41, has a base thickness that is preferably the greatest thickness of the regions 40, 42, 44 and 46. The base thickness ranges from 0.200 inch to 0.060 inch, preferably from 0.150 inch to 0.075 inch, and is most preferably within the range of 0.145 inch to 0.090 inch. A transition region 42 has a thickness that ranges between the thickness of the central region 40 and a first peripheral region 44, preferably ranges from 0.150 inch to 0.090 inch, and most preferably ranges from 0.140 inch to 0.080 inch. The first peripheral region 44 has a thickness that ranges from 0.110 inch to 0.040 inch, preferably ranges from 0.105 inch to 0.050 inch, and most preferably ranges from 0.100 inch to 0.075 inch. A second peripheral region 46 preferably is the thinnest region of the striking plate regions 40, 42, 44 and 46. The second peripheral region 46 has a thickness that ranges from 0.085 inch to 0.010 inch, preferably ranges from 0.080 inch to 0.045 inch, and most preferably ranges from 0.075 inch to 0.050 inch.

Figure 2:
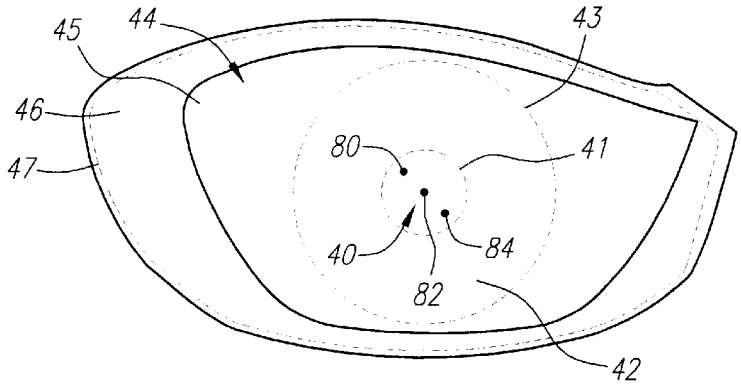
FIG. 2 is a front plan view of the striking plate of FIG. 1 showing the variable face thickness.

In a preferred embodiment, as shown in FIG. 2, the central region has a thickness range of 0.145 inch to 0.090 inch, the transition region 42 has a thickness range of 0.140 inch to 0.080 inch, the first peripheral region 44 has a thickness range of 0.105 inch to 0.090 inch, and the second peripheral region 46 has a thickness range of 0.075 inch to 0.050 inch.

Preferably, as shown in FIG. 2, the central region 40 is 5% to 15% of the surface area of the core face 49 of the striking plate 30. The core face 49 is defined as the central region 40, the transition region 42 and the first peripheral region 44. The core face area of the striking plate 30 has an area between 4.80 square inches and 5.50 square inches, preferably between 5.10 square inches and 5.40 square inches, and most preferably 5.38 square inches. The transition region 42 is preferably 35% to 50% of the surface area of the core face 49, and the first peripheral region 44 is preferably 40% to 55% of the surface area of the core face 49. In a preferred embodiment, the central region is 8.8% of the surface area of the core face 49, the transition region is 42.2% of the surface area of the core face 49, and the first peripheral region 44 is 50% of the surface area of the core face 49.

Figure 7:
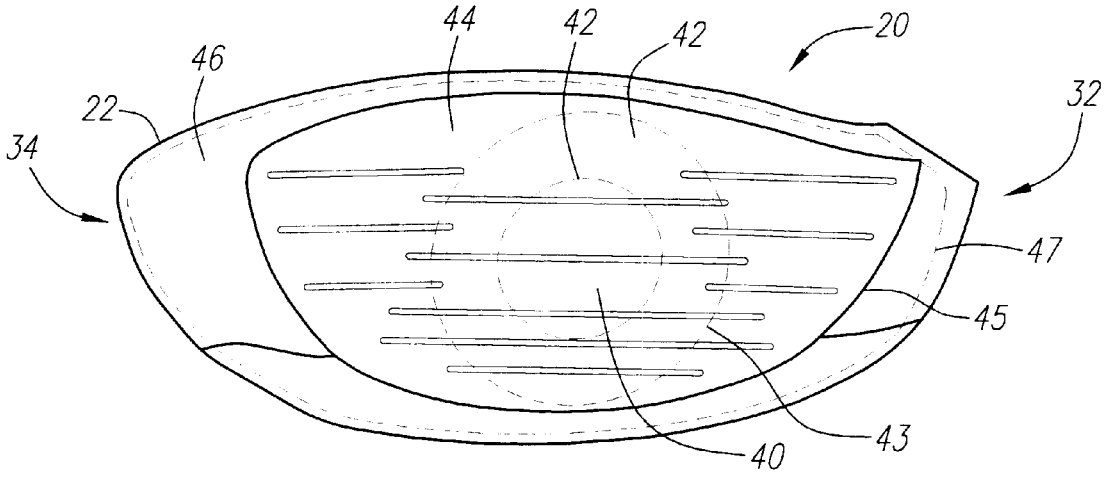
FIG. 7 is a front plan view of a fairway wood golf club head of the present invention with the variable thickness superimposed thereon.
Figure 8:
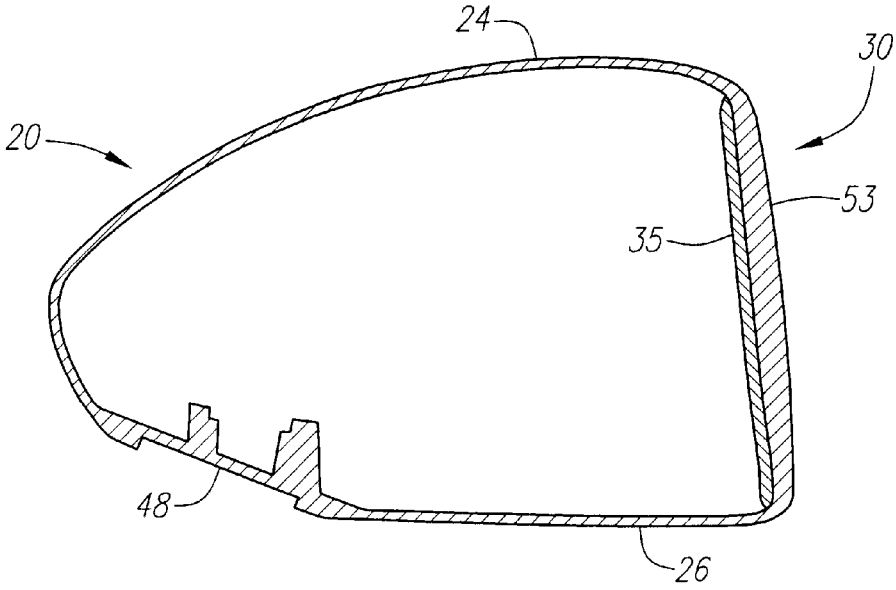
FIG. 8 is a cross-sectional view along lines 8—8 of FIG. 5.

FIG. 7 illustrates an alternative embodiment of the present invention for a fairway wood golf club head 20. In this embodiment, the central region has a thickness range of 0.135 inch to 0.125 inch, the transition region 42 has a thickness range of 0.130 inch to 0.090 inch, the first peripheral region 44 has a thickness range of 0.095 inch to 0.085 inch, and the second peripheral region 46 has a thickness range of 0.075 inch to 0.045 inch.

Table One sets forth the thickness ranges of the central region 40, the first peripheral region 44 and the second peripheral region 46 for preferred embodiments for drivers (lofts 7 degrees through 12 degrees) and fairway woods (2 wood through 9 wood).

TABLE ONE

| | Striking Plate Thickness | | |
|---|---|---|---|
| Club | Second Peripheral Region | First Peripheral Region | Center Center Region |
| 07° Driver | .050 ± .005 | .100 ± .005 | .140 ± .005 |
| 08° Driver | .050 ± .005 | .100 ± .005 | .140 ± .005 |
| 09° Driver | .050 ± .005 | .100 ± .005 | .140 ± .005 |
| 10° Driver | .050 ± .005 | .100 ± .005 | .140 ± .005 |
| 11° Driver | .050 ± .005 | .100 ± .005 | .140 ± .005 |
| 12° Driver | .050 ± .005 | .100 ± .005 | .140 ± .005 |
| 2 Wood | .050 ± .005 | .090 ± .005 | .130 ± .005 |
| 3 Wood | .055 ± .005 | .090 ± .005 | .130 ± .005 |
| Strong 3 | .060 ± .005 | .090 ± .005 | .130 ± .005 |
| 4 Wood | .060 ± .005 | .085 ± .005 | .125 ± .005 |
| Strong 4 | .065 ± .005 | .090 ± .005 | .130 ± .005 |
| 5 Wood | .065 ± .005 | .085 ± .005 | .125 ± .005 |
| 7 Wood | .070 ± .005 | .085 ± .005 | .125 ± .005 |
| 9 Wood | .075 ± .005 | .085 ± .005 | .125 ± .005 |

Figure 2A:
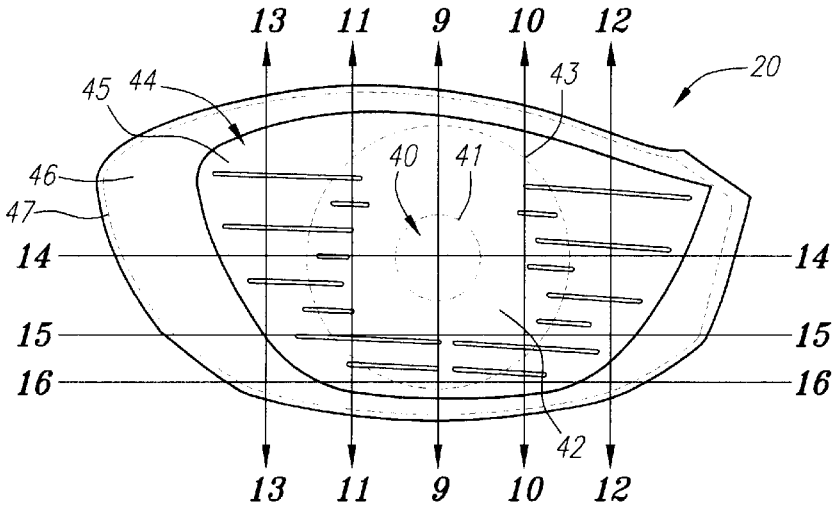
FIG. 2A is a front plan view of the golf club head of FIG. 1 with the variable face thickness pattern superimposed thereon.
Figure 2B:
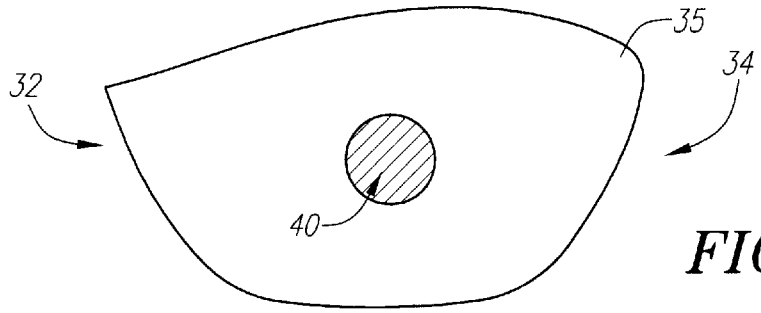
FIG. 2B is an isolated view of the interior surface of the striking plate with the vibration attenuation thereon.
Figure 3:
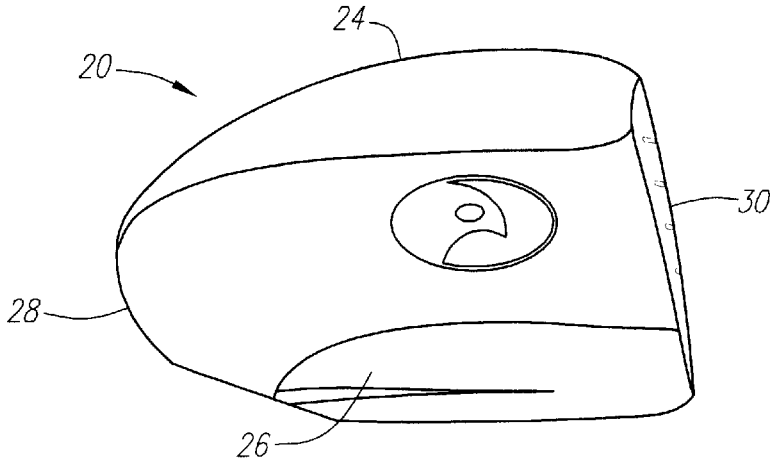
FIG. 3 is a toe side view of the golf club head of FIG. 1.
Figure 4:
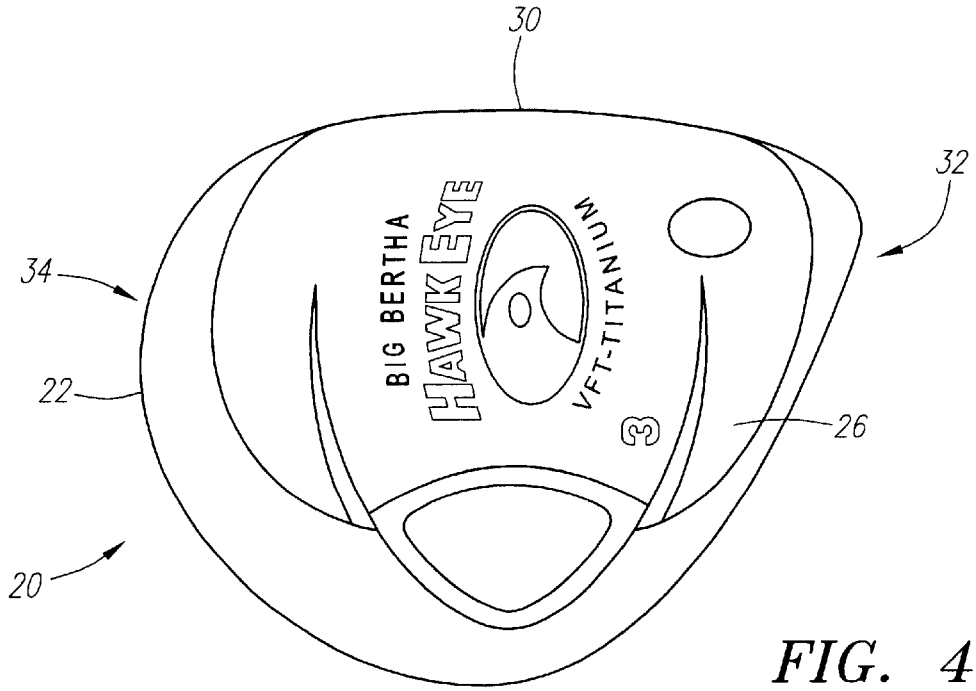
FIG. 4 is a bottom plan view of the golf club head of FIG. 1.
Figure 5:
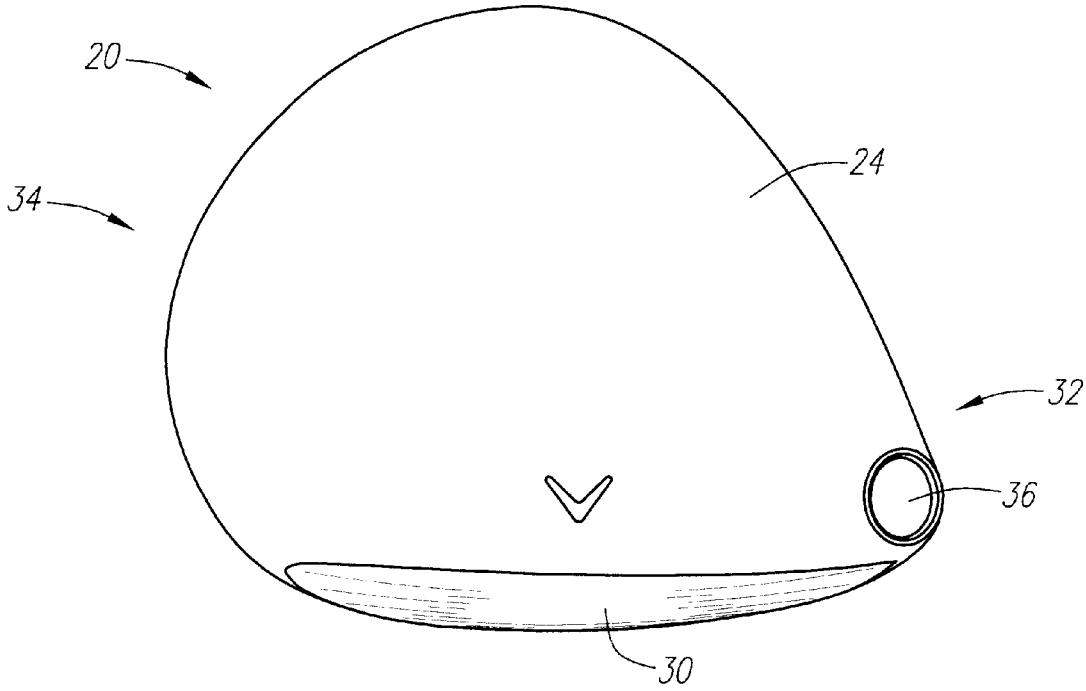
FIG. 5 is a top plan view of the golf club head of FIG. 1.
Figure 6:
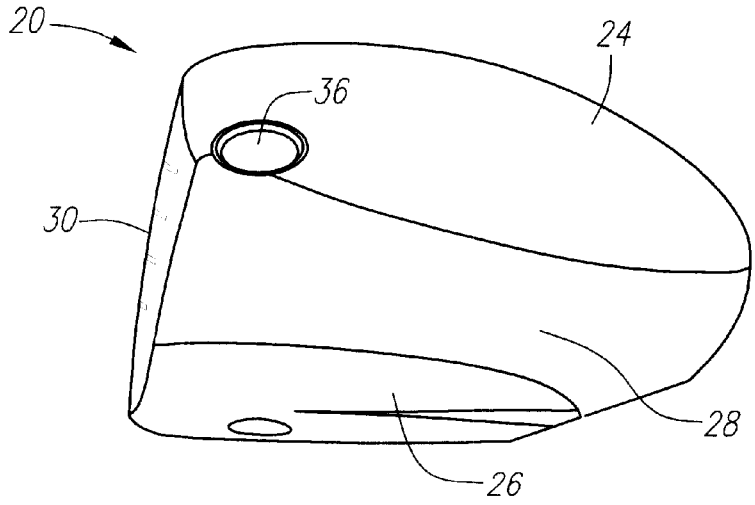
FIG. 6 is a heel side view of the golf club head of FIG. 1.

Cross-sections of the striking plate 30, taken from FIG. 2A, are illustrated in FIGS. 9–16. The striking plate 30 has variable thickness, with the thickest portion in the center. The vibration attenuation backing 35 also varies in thickness to provide a uniform overall thickness for both the striking plate 30 and the vibration attenuation backing 35. Further, the vibration attenuation backing 35 does not cover the central region 40, a shown in FIG. 2B.

Figure 9:
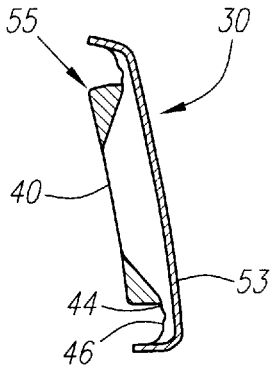
FIG. 9 is a cross-sectional view along lines 9—9 of FIG. 2A.

FIG. 9 illustrates a vertical cross-section of the mid-section of the striking plate 30 with the central region 40, the transition region 42, the first peripheral region 44 and the second peripheral region 46 on the contoured interior surface 55 as opposed to the relatively smooth, albeit scorelines, of the exterior surface 55 of the striking plate 30.

Figure 10:
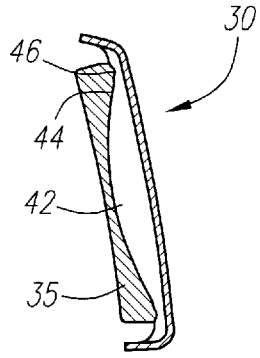
FIG. 10 is a cross-sectional view along lines 10—10 of FIG. 2A.
Figure 11:
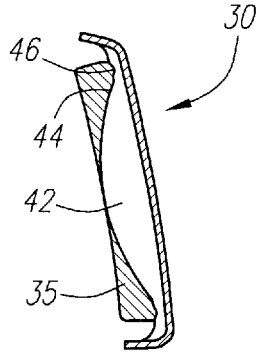
FIG. 11 is a cross-sectional view along lines 11—11 of FIG. 2A.
Figure 12:
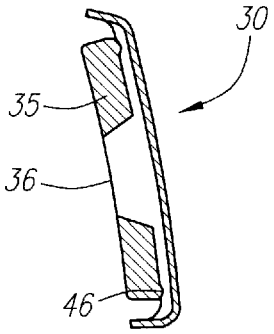
FIG. 12 is a cross-sectional view along lines 12—12 of FIG. 2A.
Figure 13:
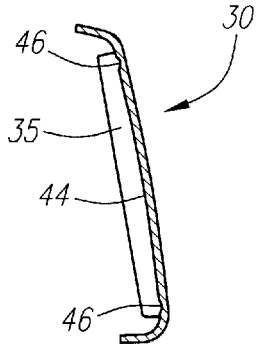
FIG. 13 is a cross-sectional view along lines 13—13 of FIG. 2A.

The vibration attenuation backing 35 only covers the transition region 42, the first peripheral region 44 and the second peripheral region 46. FIGS. 10 and 11 illustrate vertical cross-sections that are adjacent both sides of the mid-section, and which only includes the transition region 42, the first peripheral region 44 and the second peripheral region 46. FIG. 12 illustrates a vertical cross-section on the heel end 32 of the striking plate 30 that has a wall of the internal hosel 36 integrated therewith in a preferred embodiment. FIG. 12 otherwise shows the first peripheral region 44 and the second peripheral region 46. Although the wall of the internal hosel 36 is shown as integrated with the striking plate 30, alternative embodiments have the internal hosel off-set from the interior surface 55 of the striking plate 30. FIG. 13 illustrates a vertical cross-section of the toe end 34 of the striking plate 30, which only includes the first peripheral region 44 and the second peripheral region 46.

Figure 14:
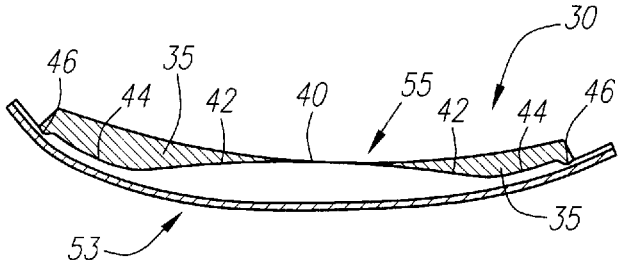
FIG. 14 is a cross-sectional view along lines 14—14 of FIG. 2A.
Figure 15:
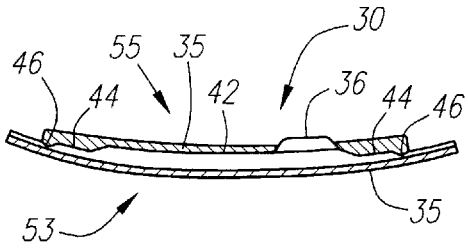
FIG. 15 is a cross-sectional view along lines 15—15 of FIG. 2A.
Figure 16:
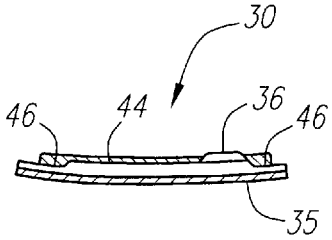
FIG. 16 is a cross-sectional view along lines 16—16 of FIG. 2A.

FIG. 14 illustrates a horizontal cross-section of the horizontal mid-section of the striking plate 30, which shows the central region 40, the transition region 42, the first peripheral region 44, the second peripheral region 46, and the wall of the internal hosel 36. The vibration attenuation backing 35 only covers the transition region 42, the first peripheral region 44 and the second peripheral region 46. FIG. 15 illustrates a horizontal cross-section below the horizontal mid-section of the striking plate 30, which only includes the transition region 42, the first peripheral region 44, the second peripheral region 46, and the wall of the internal hosel 36. FIG. 16 illustrates a horizontal cross-section further below the horizontal mid-section of the striking plate 30, which only includes the first peripheral region 44, the second peripheral region 46, and the wall of the internal hosel 36.

The striking plate 30 will also have a plurality of scorelines 75 thereon which will effect the thickness of each of the regions 40, 42, 44 and 46 at each particular scoreline 75. A more detailed explanation of the scorelines 75 is set forth in co-pending U.S. patent application Ser. No. 09/431,518, filed on Nov. 1, 1999, entitled Contoured Scorelines For The Face Of A Golf Club, and incorporated by reference in its entirety.

Figure 17:
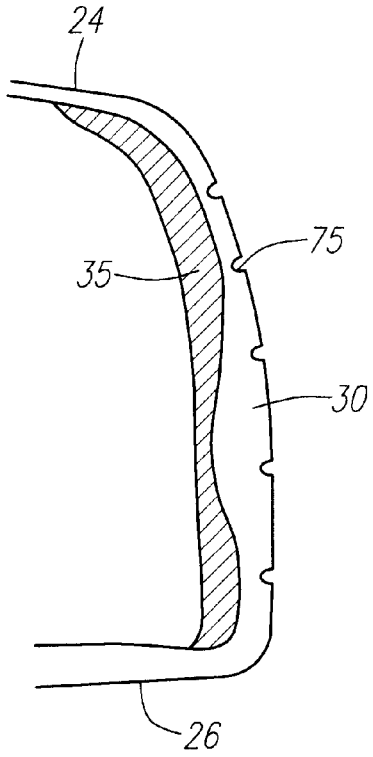
FIG. 17 is a cross-sectional view of an alternative embodiment of the present invention.
Figure 18:
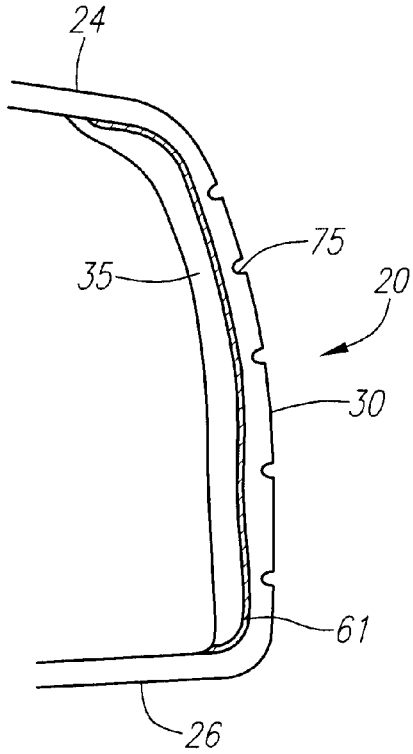
FIG. 18 is a cross-sectional view of an alternative embodiment of the present invention.

FIG. 17 illustrates an alternative embodiment of the present invention with a variable thickness striking plate 30 and a vibration attenuation backing that covers the entire interior surface 55 of the striking plate 30. FIG. 18 illustrates yet a further alternative embodiment of the present invention with a uniform thickness striking plate 30 and a vibration attenuation backing that covers the entire interior surface 55 of the striking plate 30. The embodiment of FIG. 18 has an adhesive interface 61 between the striking plate 30 and the vibration attenuation backing 35. The adhesive interface 61 bonds the vibration attenuation backing 35 to the interior surface of the striking plate 30.

The variation in the thickness of the striking plate 30 also allows for the greatest thickness of regions 40, 42, 44 and 46 to be distributed in the center region 40 of the striking plate 30 thereby enhancing the flexibility of the striking plate 30 which corresponds to greater compliance of the striking plate 30 during impact with a golf ball thereby providing for reduced energy loss with allows for greater distance.

The striking plate 3.0 is preferably composed of a stainless steel. Alternatively, the striking plate 30 is composed of a titanium or titanium-alloy material. In yet an alternative embodiment, the striking plate 30 is composed of a vitreous metal such as iron-boron, nickel-copper, nickel-zirconium, nickel-phosphorous, and the like. Yet in further alternative embodiments, the striking plate 30 is composed of ceramics, composites or other metals.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf club head comprising:

a body having a crown, a sole, a heel end, a toe end and a hollow interior;

a striking plate attached to the body, the striking plate having an exterior surface and an interior surface, the striking plate having a thickness that varies from 0.030 inch to 0.250 inch; and a vibration attenuation backing disposed on the interior surface of the striking plate within the hollow interior of the body, the combination of the striking plate and the vibration attenuation backing having a minimum thickness of at least 0.100 inch at any point between the exterior surface of the striking plate and the hollow interior;

wherein the striking plate and vibration attenuation backing are composed of materials that satisfy the following equation:

$$0.90\left(\frac{E_{35}}{E_{30}}\frac{\rho_{30}}{\rho_{35}}\right)1.10 \quad \text{and} \quad 0.90\left(\frac{G_{35}}{G_{30}}\frac{\rho_{30}}{\rho_{35}}\right)1.10$$

wherein $E_{35}$, $G_{35}$, and $_{35}$ are the material compression stiffness, shear stiffness, and density, respectively, for the vibration attenuation backing, and $E_{30}$, $G_{30}$, and $_{30}$ are the material compression stiffness, shear stiffness, and density, respectively, for the striking plate.

2. A golf club head comprising:

a body having a crown, a sole, a heel end, a toe end and a hollow interior;

a striking plate attached to the body, the striking plate comprising a central region, a transition region, a first peripheral region and a second peripheral region, the central region having a first thickness ranging from 0.125 inch to 0.145 inch and occupying 5% to 15% of the exterior surface of a core face area, the transition region encompassing the central region and occupying 35% to 50% of the exterior surface of a core face area, the first peripheral region encompassing the transition region and occupying 40% to 55% of the exterior surface of the core face, the first peripheral region having a second thickness less than the first thickness and ranging from 0.075 inch to 0.110 inch, the transition region having a thickness that transitions from the first thickness to the second thickness, the second peripheral region encompassing the first peripheral region and having a third thickness that ranges from 0.045 inch to 0.080 inch; and a vibration attenuation backing disposed on an interior surface of the striking plate within the hollow interior of the body, the vibration attenuation backing having a thickness between 0.010 inch and 0.150 inch.

3. The golf club head according to claim 2 wherein the striking plate is composed of titanium, steel or a amorphous metal.

4. The golf club head according to claim 2 wherein the vibration attenuation member is attached only to the transition region, the first peripheral region and the second peripheral region.

5. The golf club head according to claim 2 wherein the vibration attenuation member is attached only to the first peripheral region and the second peripheral region.

6. A golf club head comprising:

a body having a crown, a sole, a heel end and a toe end;

a unitary striking plate comprising a central region, a transition region, a first peripheral region and a second peripheral region, the central region having a first thickness ranging from 0.090 inch to 0.145 inch and occupying 5% to 15% of the exterior surface of a core face area, the transition region encompassing the central region and occupying 35% to 50% of the exterior surface of a core face area, the first peripheral region encompassing the transition region and occupying 40% to 55% of the exterior surface of the core face, the first peripheral region having a second thickness less than the first thickness and ranging from 0.040 inch to 0.110 inch, the transition region having a thickness that transitions from the first thickness to the second thickness, the second peripheral region encompassing the first peripheral region and having a third thickness that ranges from 0.010 inch to 0.085 inch; and a vibration attenuation backing disposed on an interior surface of the striking plate within the hollow interior of the body, the vibration attenuation backing having a thickness between 0.010 inch and 0.150 inch.

7. The golf club head according to claim 6 wherein the unitary striking plate is composed of a material selected from the group consisting of titanium, titanium alloys, steels, vitreous metals, ceramics, composites, carbon materials, carbon fiber materials, other fibrous materials and mixtures thereof.

8. The golf club head according to claim 6 wherein the central region occupies approximately 8.8% of the core face area, the transition region occupies 42.2% of the core face area and the first peripheral region occupies 50% of the core face area.

9. The golf club head according to claim 6 wherein the body has a hollow interior.

10. The golf club head according to claim 6 wherein the body has a volume greater than 300 cubic centimeters and weighs less than 215 grams.

11. The golf club head according to claim 6 wherein the core face area of the unitary striking plate has an area between 4.80 square inches and 5.40 square inches.

12. The golf club head according to claim 6 wherein the striking plate has the durability to endure 2000 impacts with a golf ball at 100 miles per hour without failure of the striking plate.

* * * * *